US007785031B2

(12) United States Patent
Vellozzi et al.

(10) Patent No.: US 7,785,031 B2
(45) Date of Patent: Aug. 31, 2010

(54) ENERGY ABSORBING SYSTEM

(75) Inventors: Joseph Vellozzi, Ardsley, NY (US); Matthew A. Gelfand, Rockville Centre, NY (US); John S. Paner, Lancaster, NY (US); Norman D. Mackenzie, Alden, NY (US); Shubin Ruan, Williamsville, NY (US); D. Lance Bullard, Jr., College Station, TX (US); Dean C. Alberson, Bryan, TX (US)

(73) Assignee: Universal Safety Response, Inc., Franklin, TN (US)

( * ) Notice: Subject to any disclaimer, the term of this patent is extended or adjusted under 35 U.S.C. 154(b) by 670 days.

(21) Appl. No.: 10/504,068

(22) PCT Filed: Feb. 6, 2003

(86) PCT No.: PCT/US03/03586

§ 371 (c)(1),
(2), (4) Date: Aug. 10, 2005

(87) PCT Pub. No.: WO03/066967

PCT Pub. Date: Aug. 14, 2003

(65) Prior Publication Data

US 2006/0002760 A1 Jan. 5, 2006

Related U.S. Application Data

(63) Continuation-in-part of application No. 10/359,666, filed on Feb. 6, 2003, now Pat. No. 6,843,613.

(60) Provisional application No. 60/421,144, filed on Feb. 7, 2002.

(51) Int. Cl.
*E01F 15/00* (2006.01)

(52) U.S. Cl. ..... 404/6; 404/10; 49/9; 49/33; 49/34; 49/49

(58) Field of Classification Search ..... 49/9, 49/33, 34, 49, 131; 256/13.1; 404/6, 10
See application file for complete search history.

(56) References Cited

U.S. PATENT DOCUMENTS 1,344,776 A 6/1920 Strieter (Continued)

FOREIGN PATENT DOCUMENTS

EP 0808948 11/1997

(Continued)

OTHER PUBLICATIONS

GD-OTS-Homeland Defense Systems, "Portable Vehicle Arresting Barrier (PVAB)", Aug. 29, 2003, http://www.gd-ots.com/site_pages/nonleth/pvab.html.

(Continued)

*Primary Examiner*—Gary S Hartmann

(57) ABSTRACT

A heavy duty ground retractable automobile barrier for a railroad crossing. Concrete bunkers are placed at each side of a roadway. An upstanding concrete-filled steel pipe fixed in each bunker has a sleeve for rotational and axial movement. Shock absorbers are mounted on each sleeve. A net extends across the road and is attached to the opposite ends of the shock absorbers. Collision of an automobile with the net creates tensile forces in the net. The shock absorbers expand while rotating about the pipe's axis in response to tensile forces from the net that meet or exceed a minimum threshold. Forces from the net pass through the axis of the steel pipe. The net is stored in a pit transverse the roadway parallel to the railroad tracks and is raised and lowered as appropriate. The net includes a cable that extends across the road in a wave pattern, having peaks, valleys and midpoints, wherein tangents of the wave midpoints are at least 90 degrees from tangents of the peaks and valleys.

10 Claims, 10 Drawing Sheets

U.S. PATENT DOCUMENTS

| | | | | |
|---|---|---|---|---|
| 1,437,404 | A | 12/1922 | Donovan | |
| 1,661,051 | A | 2/1928 | Siano | |
| 1,818,824 | A | 8/1931 | Strauss | |
| 1,929,859 | A | 10/1933 | Stauss | |
| 2,043,525 | A | 6/1936 | Benedict | |
| 2,189,974 | A | 2/1940 | Buford | |
| 2,219,127 | A | 10/1940 | Buford | |
| 2,237,106 | A | 4/1941 | Minert | |
| 2,251,699 | A | 8/1941 | Banschbach | |
| 2,336,483 | A | 12/1943 | Hoover | |
| 2,440,574 | A * | 4/1948 | Cotton | 244/110 R |
| 2,465,936 | A | 3/1949 | Schultz | |
| 2,854,201 | A | 9/1958 | Cotton | |
| 3,638,913 | A | 2/1972 | Persicke | |
| 3,674,115 | A | 7/1972 | Young et al. | |
| 3,738,599 | A | 6/1973 | Borehag | |
| 3,810,595 | A | 5/1974 | Doolittle | |
| 3,827,660 | A | 8/1974 | Doolittle | |
| 3,866,367 | A | 2/1975 | Striziki | |
| 3,897,920 | A | 8/1975 | DiGiovanniantonio | |
| 3,938,763 | A | 2/1976 | DiGiovanniantonio | |
| 4,056,247 | A | 11/1977 | Bernard | |
| 4,102,518 | A | 7/1978 | Bernard | |
| 4,143,840 | A | 3/1979 | Bernard | |
| 4,456,205 | A | 6/1984 | Alavoine | |
| 4,490,068 | A | 12/1984 | Dickinson | |
| 4,509,577 | A | 4/1985 | Priefert | |
| 4,576,507 | A | 3/1986 | Terio | |
| 4,699,197 | A | 10/1987 | Hamrick et al. | |
| 4,715,742 | A | 12/1987 | Dickinson | |
| 4,742,898 | A | 5/1988 | Lee | |
| 4,760,621 | A | 8/1988 | Stromquist | |
| 4,780,020 | A | 10/1988 | Terio | |
| 4,809,933 | A | 3/1989 | Buzby | |
| 4,824,282 | A | 4/1989 | Waldecker | |
| 4,844,653 | A | 7/1989 | Dickinson | |
| 4,979,701 | A | 12/1990 | Colarik | |
| 5,118,056 | A | 6/1992 | Jeanise | |
| H1133 | H | 2/1993 | Bridges et al. | |
| 5,310,277 | A | 5/1994 | Uotila | |
| 5,332,071 | A | 7/1994 | Duncan | |
| 5,762,443 | A | 6/1998 | Gelfand et al. | |
| 5,829,912 | A | 11/1998 | Marcotullio | |
| 5,947,452 | A | 9/1999 | Albritton | |
| 5,975,792 | A | 11/1999 | Goeken | |
| 5,993,104 | A | 11/1999 | Marcotullio et al. | |
| 6,131,873 | A | 10/2000 | Blazon | |
| 6,312,188 | B1 | 11/2001 | Ousterhout et al. | |
| 6,382,869 | B1 | 5/2002 | Dickinson | |
| 6,843,613 | B2 | 1/2005 | Gelfand et al. | |
| 7,083,357 | B2 * | 8/2006 | Lamore | 404/6 |
| 7,140,802 | B2 * | 11/2006 | Lamore | 404/6 |
| 7,195,419 | B2 * | 3/2007 | Gelfand | 404/6 |
| 7,210,873 | B2 * | 5/2007 | Gelfand | 404/6 |
| 2002/0085880 | A1 | 7/2002 | Schneider et al. | |

FOREIGN PATENT DOCUMENTS

| | | | |
|---|---|---|---|
| JP | 63-55283 | A | 3/1988 |
| JP | 7-10278 | | 2/1995 |
| JP | 11-303025 | A | 11/1999 |
| JP | 2000-154510 | | 6/2000 |
| JP | 2000248514 | | 9/2000 |
| WO | WO 8910302 | | 11/1989 |
| WO | WO 9005809 | | 5/1990 |
| WO | WO 9202688 | | 2/1992 |
| WO | WO 9715729 | | 5/1997 |

OTHER PUBLICATIONS

Markland Technologies, "Vehicle Stopping System (VSS)", Aug. 29, 2003, http://www.marklandtech.com/vss.html; pp. 1-2.

* cited by examiner

ENERGY ABSORBING SYSTEM

RELATED APPLICATIONS

This application is the National Stage of International Application No. PCT/US03/03586, entitled "Energy Absorbing System" and filed Feb. 6, 2003, which claims priority from Non-provisional application Ser. No. 10/359,666, U.S. Pat. No. 6,843,613, entitled "Energy Absorbing System" and filed Feb. 6, 2003, which claims priority from U.S. Provisional Application Ser. No. 60/421,144, entitled "Energy Absorbing System", filed on Feb. 7, 2002, and converted to a provisional application on Feb. 5, 2003. International Application No. PCT/US03/03586, also claims priority from U.S. Provisional Application Ser. No. 60/421,144, entitled "Energy Absorbing System", filed on Feb. 7, 2002, and converted to a provisional application on Feb. 5, 2003.

BACKGROUND OF THE INVENTION

This invention relates to an energy absorbing system that can be used to dissipate unwanted energy such as, e.g., the energy of an errant vehicle. The system can be used in a variety of applications, including HOV lane traffic control, drawbridges, security gates, or crash cushion applications. In one application, the system is used to prevent a vehicle from crossing a railroad track while the warning gates are down or there is a train in the area.

The problem of vehicles improperly crossing railroad tracks is becoming more pronounced due to a rise in both the average speed of trains and in the number of vehicles on the roads. For example, a new high speed rail line has recently been put into service on the east coast of the United States, which passes through densely populated areas. Traditional systems for preventing vehicles from crossing the tracks at inopportune times have proved less than fully satisfactory. Traditional gates can be bypassed by impatient drivers who don't yet see a train coming, and, in any event, will not stop a vehicle that is out of control.

Other vehicle barriers have been proposed, but none have solved the problem in a manner that is both feasible and commercially practical. Thus, old-fashioned gates are still the most common system for protecting railroad crossings.

SUMMARY OF THE INVENTION

In one aspect, an energy absorbing system according to the present invention includes a stanchion, a bearing sleeve rotatable around the stanchion, one or more hydraulic shock absorbers in its compressed state connected to the sleeve, a threshold force securing mechanism connected to the shock absorbers, and a ground retractable restraining net connected to the shock absorbers, wherein the securing mechanism prevents expansion of the shock absorbers until acted upon by tensile forces of at least a minimum threshold force, wherein the minimum threshold force exceeds a static tensile force exerted by the restraining net in a quiescent state upon the shock absorber, and wherein the minimum threshold force is less than dynamic tensile forces that the net would exert on the shock absorber when an automobile collides with the net at substantial speed.

In another aspect, an energy absorbing system according to the present invention includes a fixing means for fixing a vertical axis, a shock absorbing means connected to the fixing means, for absorbing tensile forces while rotating around the vertical axis, and a threshold force securing means connected to the shock absorbing means, for preventing expansion of the shock absorbing means until acted upon by tensile forces of at least a minimum threshold force. Preferably, the shock absorbing means is connected to a rotating means for rotating about the fixing means and/or axis. The rotating means may be a bearing sleeve, for example. The energy absorbing system may further comprise a torque protection means for adding structural strength to the shock absorbing means to resist deformation due to the torque upon the shock absorbing means. A restraining means may be connected to the shock absorbing means, for absorbing forces and for transferring forces to the shock absorbing means, and through the shock absorbing means to the support means. The restraining means may include a restraining net or net means. It preferably comprises horseshoe cable, or cable extending substantially horizontally in a wave pattern with vertical amplitude, having peaks, valleys and midpoints, wherein tangents of the wave midpoints are at least 90 degrees from tangents of the peaks and valleys.

In yet another aspect, an energy absorbing system according to the present invention includes a stanchion, a bearing sleeve rotatable and optionally vertically slidable on the stanchion, a shock absorber connected to the sleeve, and a shear pin connected to the shock absorber which prevents expansion of the shock absorber until acted upon by tensile forces of at least a minimum threshold force. Preferably, the minimum threshold force is about 3,000 to about 15,000 pounds. Most preferably, the minimum threshold force is about 5,000 to about 10,000 pounds. The energy absorbing system may include wheels and a cross-bar between at least two shock absorbers on a stanchion, supporting the shock absorbers.

In a further aspect, an energy absorbing system according to the present invention includes a stanchion, a bearing sleeve rotatable and optionally vertically slidable on the stanchion, a shock absorber connected to the sleeve, a restraining net connected to the shock absorber, and a shear pin connected to the shock absorber which prevents expansion of the shock absorber until acted upon by tensile forces of at least a minimum threshold force. Preferably, the restraining net in a quiescent state exerts a static tensile force upon the shock absorber, and the minimum threshold force exceeds the static tensile force. The net preferably extends across a roadway and is ground retractable. The net preferably comprises horseshoe cable, or cable extending substantially horizontally in a wave pattern with vertical amplitude, having peaks, valleys and midpoints, wherein tangents of the wave midpoints are at least 90 degrees from tangents of the peaks and valleys.

In a still further aspect, a restraining net according to the present invention includes top, middle and bottom horizontally extending structural cables, and horseshoe cable extending along and between the horizontally extending cables, or cable extending substantially horizontally along the horizontally extending structural cables in a wave pattern with vertical amplitude, having peaks, valleys and midpoints, wherein tangents of the wave midpoints are at least 90 degrees from tangents of the peaks and valleys.

In yet another aspect, a railroad crossing safety system according to the present invention includes a roadway, railroad tracks crossing the roadway, first and second energy absorbing systems installed respectively on each side of the roadway, ground retractable restraining means for restraining automobiles from crossing the railroad tracks, the restraining means extending across the roadway between the first and second energy absorbing systems on each side of the railroad tracks, each of the first and second energy absorbing systems comprising supporting means for providing a rigid support for a fixing means, fixing means for rigidly fixing a vertical axis relative to the supporting means, shock absorbing means for absorbing forces applied to the shock absorbing system, the shock absorbing means being mounted on the fixing means to rotate around the vertical axis, and a threshold force securing mechanism connected to the shock absorber preventing expansion of the shock absorber until acted upon by tensile forces of at least a minimum threshold force, wherein the restraining means comprises horseshoe cable.

DETAILED DESCRIPTION OF THE PREFERRED EMBODIMENTS

Figure 1A:
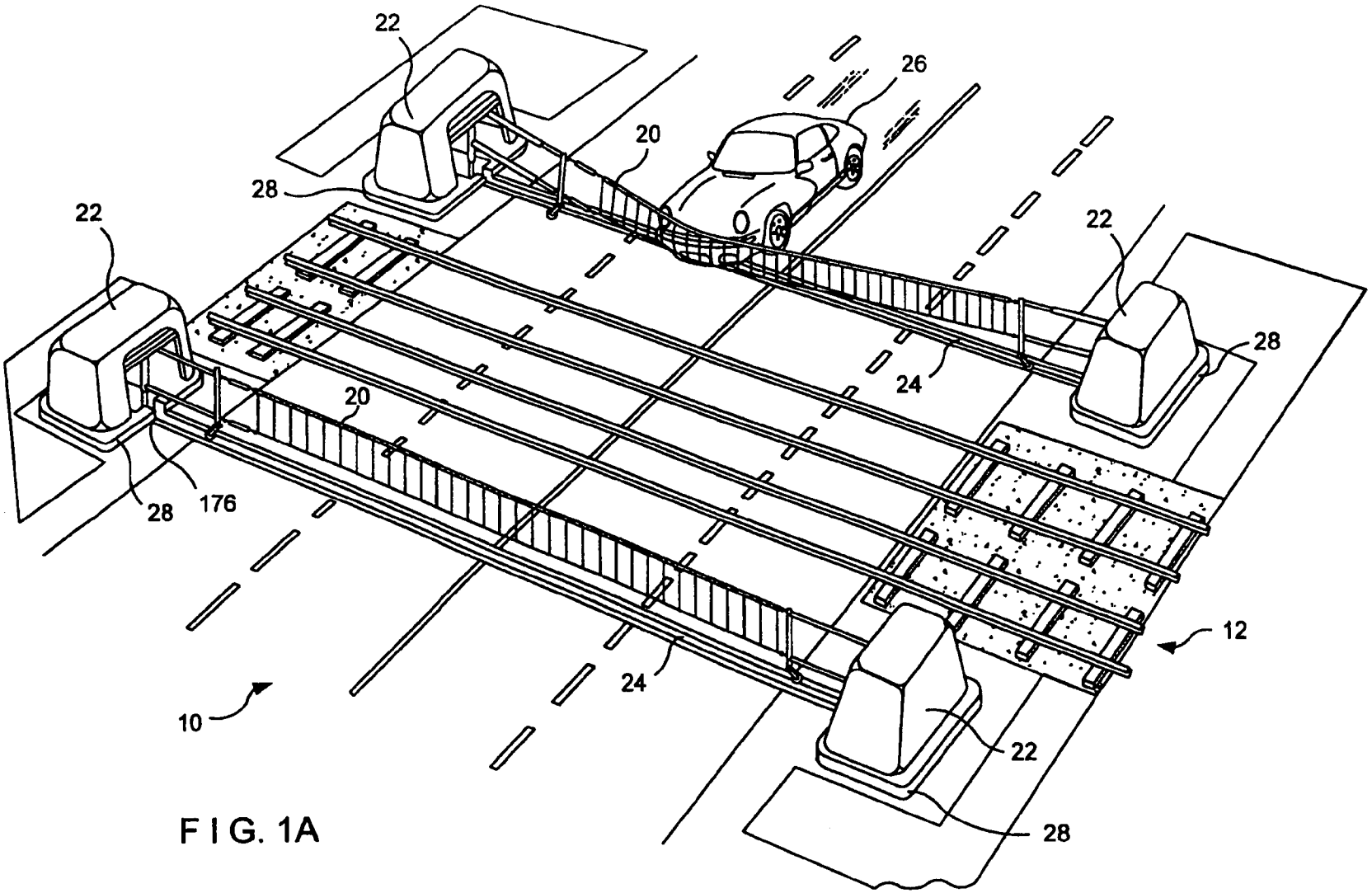
FIG. 1A is a perspective view which illustrates a railroad crossing for a multi-lane roadway with one embodiment of the invention installed and restraining an automobile.

The energy absorbing system in one aspect of a preferred embodiment comprises a stanchion or other mechanism for providing a fixed vertical axis, shock absorbing mechanisms mounted on the stanchion for absorbing forces, and a restraining net or other barrier connected to the shock absorbing mechanism. The shock absorbing mechanism is preferably mounted for rotation about the axis and is expandable in a direction substantially orthogonal to the axis.

Preferably, the shock absorbing mechanism is a hydraulic shock absorber with a securing mechanism such that the piston does not expand except in response to tensile forces that meet or exceed a minimum threshold force. In one aspect, it is envisioned that static tension from the restraining net in its quiescent state would not exceed this minimum threshold force, but that increased tension due to the dynamic tensile forces exerted upon the shock absorber from an automobile driving into the restraining net would exceed this minimum threshold force.

In accordance with other embodiments, a restraining net comprises top, middle and bottom horizontally extending structural cables. Cable arranged in horseshoe-curves extends along and among the horizontally extending cables. The term "horseshoe-curve" includes a curve in the form of a wave with a plurality of horseshoe-shaped peaks and a plurality of horseshoe-shaped valleys. It has been found that such cable has improved capturing ability. In preferred embodiments, this cable extends substantially horizontally in a wave pattern with vertical amplitude (similar to a sine wave), having peaks, valleys and midpoints, wherein tangents of the wave midpoints are at least 90 degrees from tangents of the peaks and valleys, as is explained further below.

Referring to the drawings, wherein like reference numerals represent identical or corresponding parts throughout the several views, and more particularly to FIG. 1, a general layout of an embodiment is shown installed at a typical railroad crossing. A roadway is indicated generally by reference numeral 10 and railroad tracks are indicated generally by reference numeral 12. A pair of capture nets 20 are stretched across roadway 10 parallel to tracks 12. Each capture net 20 extends between a pair of housings 22 located on opposite sides of roadway 10. The net 20 is connected at each end to shock absorbers which in turn are connected to, or may be considered part of, mechanisms for raising and lowering nets 20, as described in greater detail hereinafter. The mechanisms may be entirely contained in the housings. Alternatively, the mechanisms may protrude from the housings as shown in FIG. 1. Alternatively, the housings may be omitted altogether. The mechanisms are under the control of a standard train-detecting system, such as is commonly used to control gates at railroad crossings. Each housing 22 covers a support 28 which provides support and stability.

Preferably, each net 20 is normally stored in a slot 24 that extends transversely across roadway 10 between housings 22. Shown at the top of FIG. 1 is a vehicle 26 which has crashed into net 20 and is restrained by net 20 to prevent it and its occupants from encroaching onto tracks 12 when the train passes through. Top net 20 has been deflected by the collision from its quiescent state so as to form a shallow "V" shape. The ability to be deflected, yet provide a restraining force, allows vehicle 26 to be progressively stopped, thereby lessening adverse effects of the impact forces acting on vehicle 26 and its occupants. The deflecting and restraining functions are achieved by a unique energy absorbing system, to be described in greater detail hereinafter.

Figure 2A:
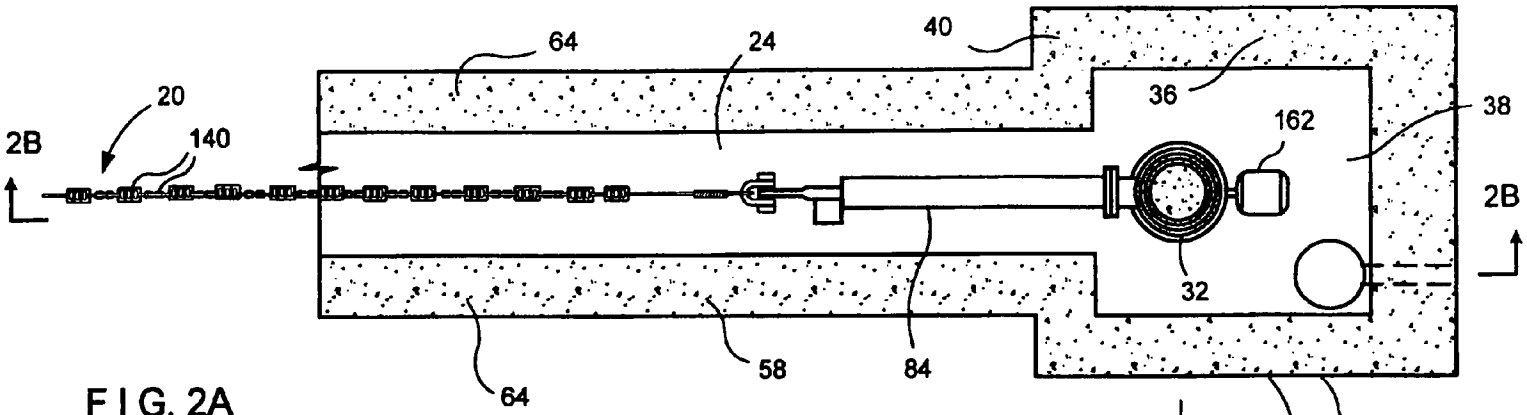
FIG. 2A is a top view, partially cut away, of an embodiment as it would appear on one side of the railroad track.
Figure 2B:
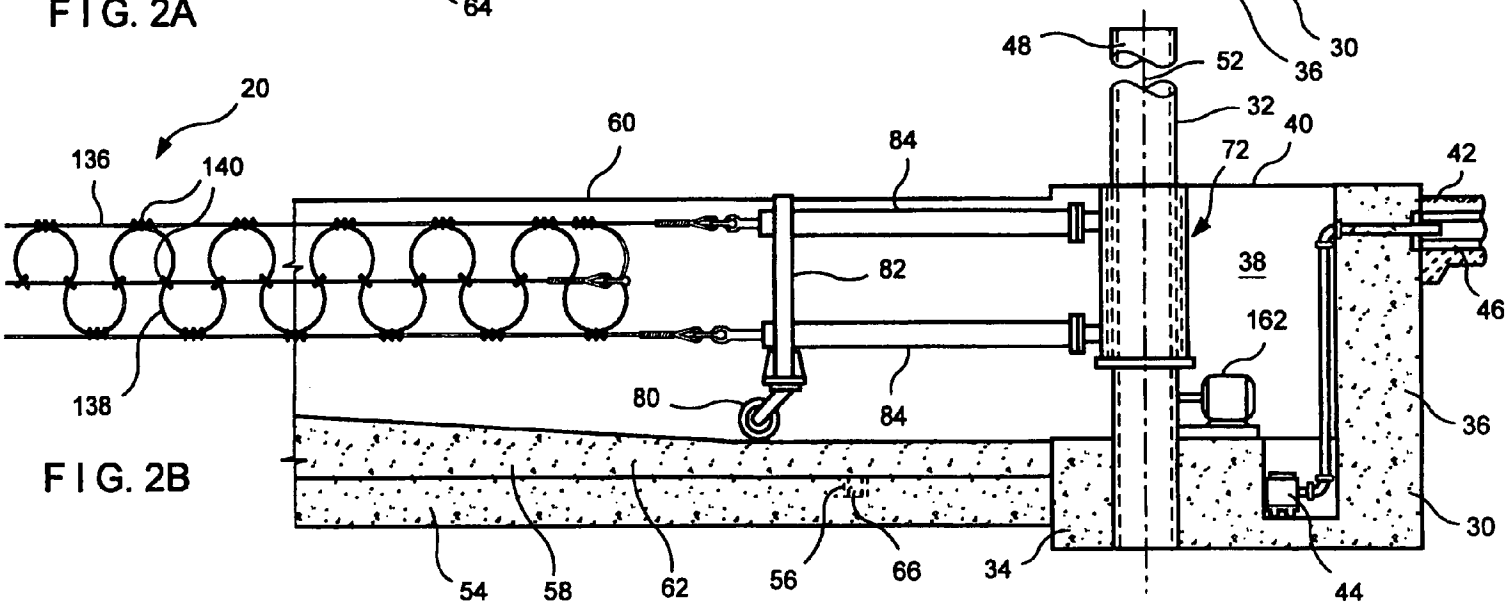
FIG. 2B is a side view, partially in section, of a net slot, a bunker, a net, a stanchion, and a net raising and lowering mechanism, which includes a pair of hydraulic shock absorbers with threshold force securing mechanism, with wheels and a vertical cross-bar to support the shock absorbers.
Figure 2C:
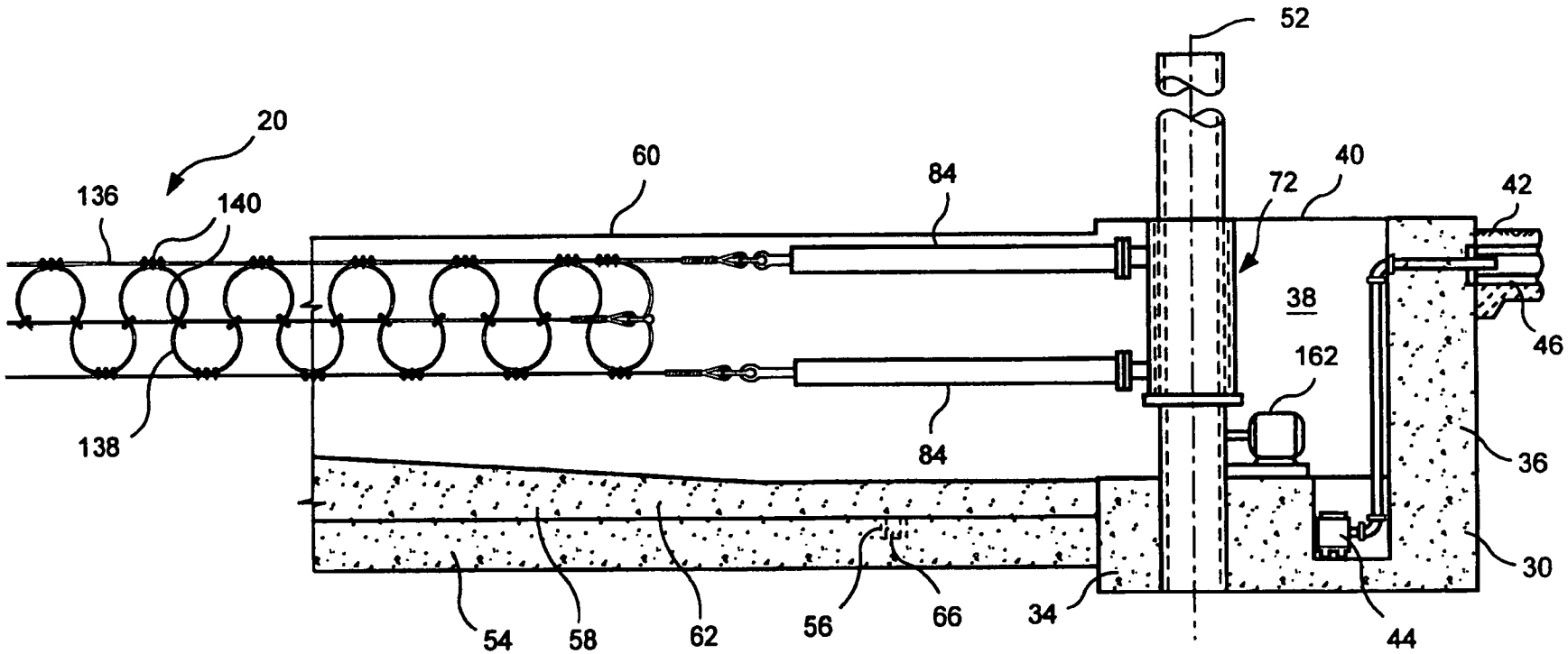
FIG. 2C is a side view, partially in section, of a net slot, a bunker, a net, a stanchion, and a net raising and lowering mechanism, which includes a pair of hydraulic shock absorbers with threshold force securing mechanism, without wheels and a vertical cross-bar to support the shock absorbers.

A top view is shown in FIG. 2A with roadway 10 and housings 22 removed. FIG. 2B shows a side view along the lines 2B-2B of FIG. 2A. FIG. 2C shows a similar view. Support 28 comprises a concrete bunker 30 and a stanchion 32. Stanchion 32 is a structure for rigidly fixing vertical axis 52. Bunker 30 may be poured at the site, or it may be fabricated elsewhere and installed at the site, on each side of roadway 10 and comprises a foundation 34 and upstanding bunker walls 36. Walls 36 define in bunker 30 a pit 38 which is open upwardly toward roadway 10. Foundation 34 may typically, for example, be from two to twelve feet wide and from three to nine feet deep. The top 40 of walls 36 are preferably about six inches above ground level 42 to provide a protective curb around bunker 30. A sump pump 44 is preferably provided to remove any water which might accumulate in pit 38 into a drainage pipe 46.

Stanchion 32, which may comprise a twenty-five inch steel pipe 48, is filled with concrete 50 and is preferably embedded approximately four feet deep in foundation 34 at the bottom of pit 38 and extends five to six feet above the top of foundation 34. Stanchion 32 has a vertical axis 52, whose function will become clear hereinafter. Foundation 34 and walls 36 may be of solid concrete. Because of the size and mass of the support 28, it provides a solid support which resists forces imposed upon it.

Also typically at the site is a concrete roadway foundation 54 which extends across roadway 10 to another bunker 30, not described in detail, since all bunkers 30 may be identical. Roadway foundation 54 preferably includes at least one key slot 56 which comprises a recess of any convenient size and shape.

Roadway foundation 54 supports a pair of pre-cast, concrete structures 58, 58' which comprise the net slots 24, 24' in the roadway into which net 20 is lowered for storage. As shown in FIGS. 2B and 2C, the top 60 of net slots 24, 24' are at ground level 42, so that they are flush with the surface of roadway 10. Structures 58, 58' form essentially a pair of net slots 24, 24' which are shown end to end in FIGS. 2A-2C. Each of structures 58, 58' are substantially U-shaped having a base 62, 62' and a pair of upstanding arms 64, 64' defining slots 24, 24'. Inasmuch as concrete structures 58 and 58' are mirror images, otherwise being identical, the following explanation of structure 58 is also applicable to 58'. An example net slot 24 is shown in cross-sectional view in FIG. 8 of U.S. Pat. No. 5,762,443 to Gelfand et al., incorporated herein by reference.

The partial cross-section shown in FIGS. 2B and 2C bisects slot 24 and pit 38. The upper surface of base 62 slopes toward pit 38 to permit runoff from accumulating in slot 24, where it might freeze and cause an obstruction. Note that the slopes shown in FIGS. 2B and 2C may be decreased. The concrete structures 58 that form net slots 24 may be pre-cast elsewhere and then transported to the site. Base 62 of net slot 24 preferably has at least one downwardly extending key 66 which is of a complementary size and shape to key slot 56. Key 66 aids in aligning the system with roadway foundation 54 and resists any shearing movement of concrete structure 58 relative to roadway foundation 54. After key 66 has been fit into key slot 56, key slot 56 is preferably grouted solid. Pre-casting the concrete structure 58 and providing it with key 66 simplifies the construction at the site, thereby reducing construction costs.

As shown in FIGS. 2B and 2C, respectively, the energy absorbing system may be provided with or without wheels 80 and a vertical cross-bar 82 between the shock absorbers to support the shock absorbers. The cross-bar may also alleviate vertical torque on the shock absorbers, which might otherwise occur due to the fact that a vehicle colliding with the net causes the top and bottom cables (and therefore the shock absorbers) to tend to squeeze together. Thus, the cross-bar may act as a stabilizer against this vertical torque. The wheels 80 and cross-bar 82 are particularly preferred when the shock absorbers 84 are long and/or heavy. Although the wheels 80 and cross-bar 82 are shown in the net configuration comprising horseshoe cable, it is understood that they may be employed in other net configurations, including the configuration shown in FIG. 1A. In addition, one may readily appreciate that skid plates or other supporting means may be used in combination with, or as a replacement for the wheels.

Referring to FIGS. 4, 5, 6 and 7, a preferred embodiment of the energy absorbing system comprises a bearing sleeve 72 which is rotatable and vertically slidable on stanchion 32, and a pair of shock absorbers 84 mounted on bearing sleeve 72 by securing shock absorber flange 114 to bearing sleeve flange 116. The shock absorbers 84 are equipped with a threshold force securing mechanism, as described in more detail below.

Figure 5:
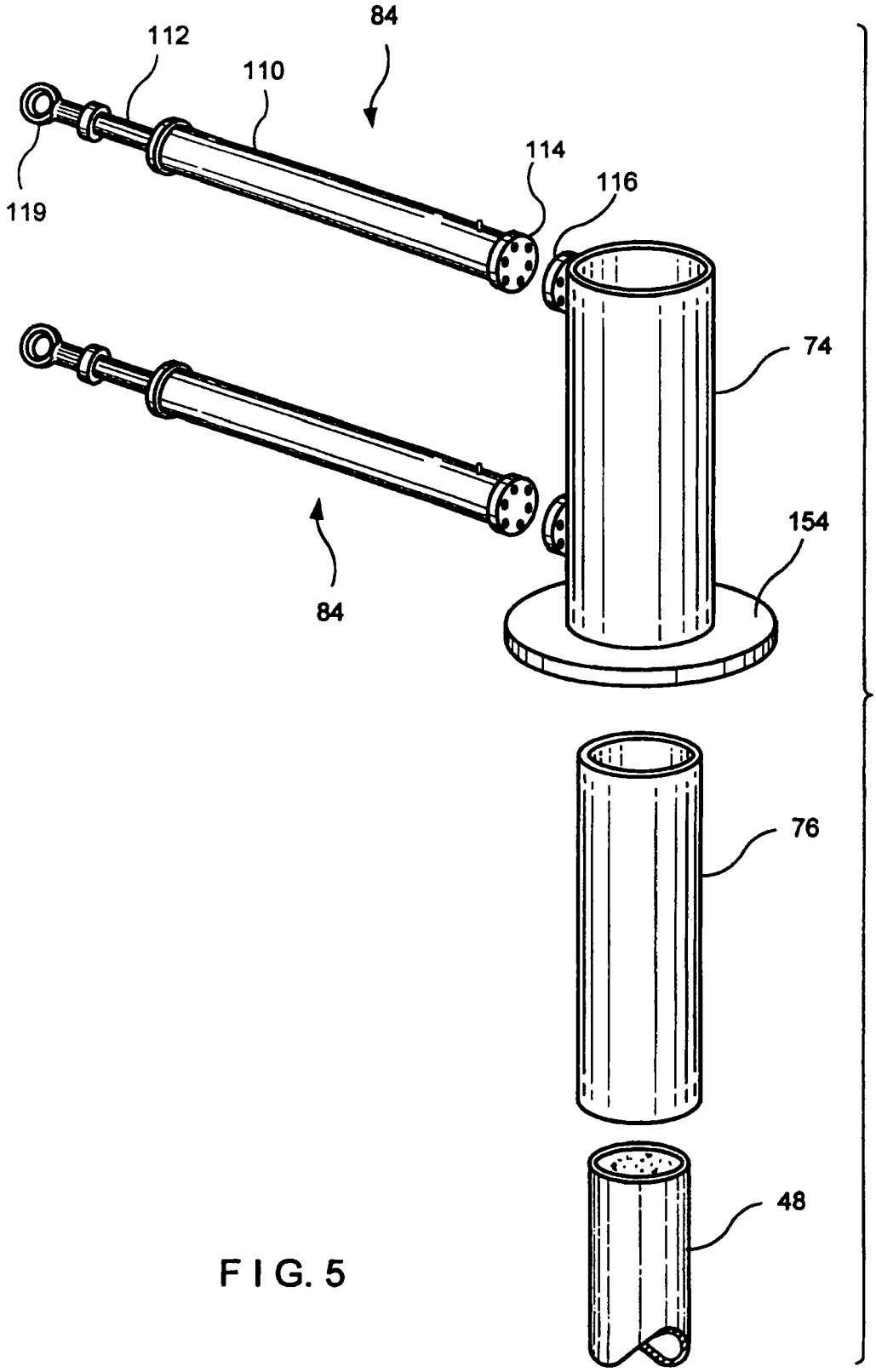
FIG. 5 is an exploded, perspective view of a stanchion with sleeve and shock absorbers with threshold force securing mechanism.

Stanchion 32 is embedded in foundation 34, thereby rigidly fixing in concrete the location of vertical axis 52. Slidable vertically on stanchion 32 is bearing sleeve 72. Preferably, as seen in FIGS. 4 and 5, bearing sleeve 72 comprises a galvanized steel sleeve 74 with a lubrite bronze insert 76 press fit therewithin which is reamed to fit externally milled stanchion 32. In FIG. 5, insert 76 is shown separate from steel sleeve 74. Mounted on bearing sleeve 72, one above the other, are two shock absorbing mechanisms 84 (FIG. 5).

Figure 3A:
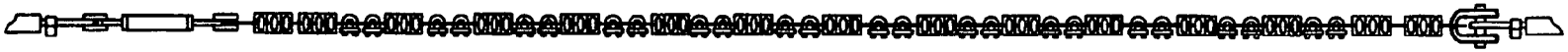
FIG. 3A is a top view of a second embodiment as it would appear on one side of the railroad track.
Figure 3B:
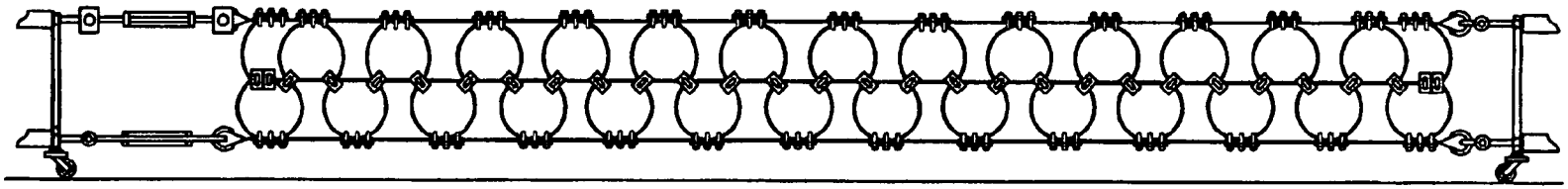
FIG. 3B is a side view of a second embodiment as it would appear on one side of the railroad track, with wheels and a vertical cross-bar to support the shock absorbers.
Figure 3C:
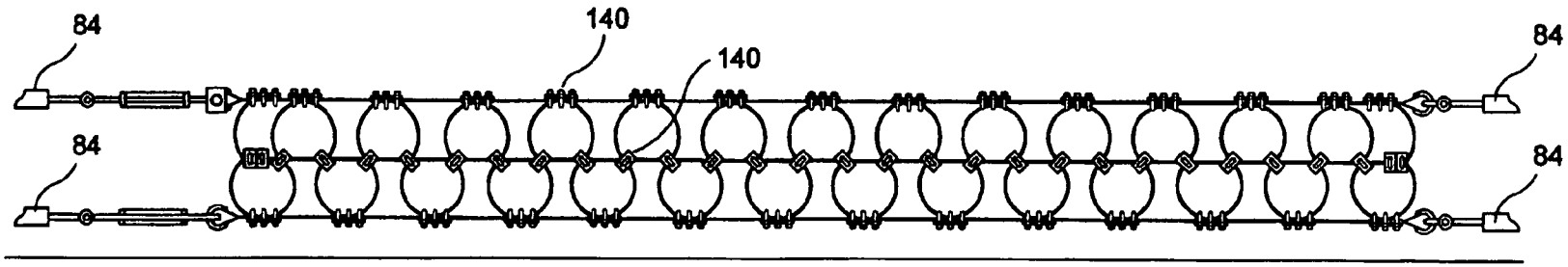
FIG. 3C is a side view of a second embodiment as it would appear on one side of the railroad track, without wheels and a vertical cross-bar to support the shock absorbers.
Figure 4A:
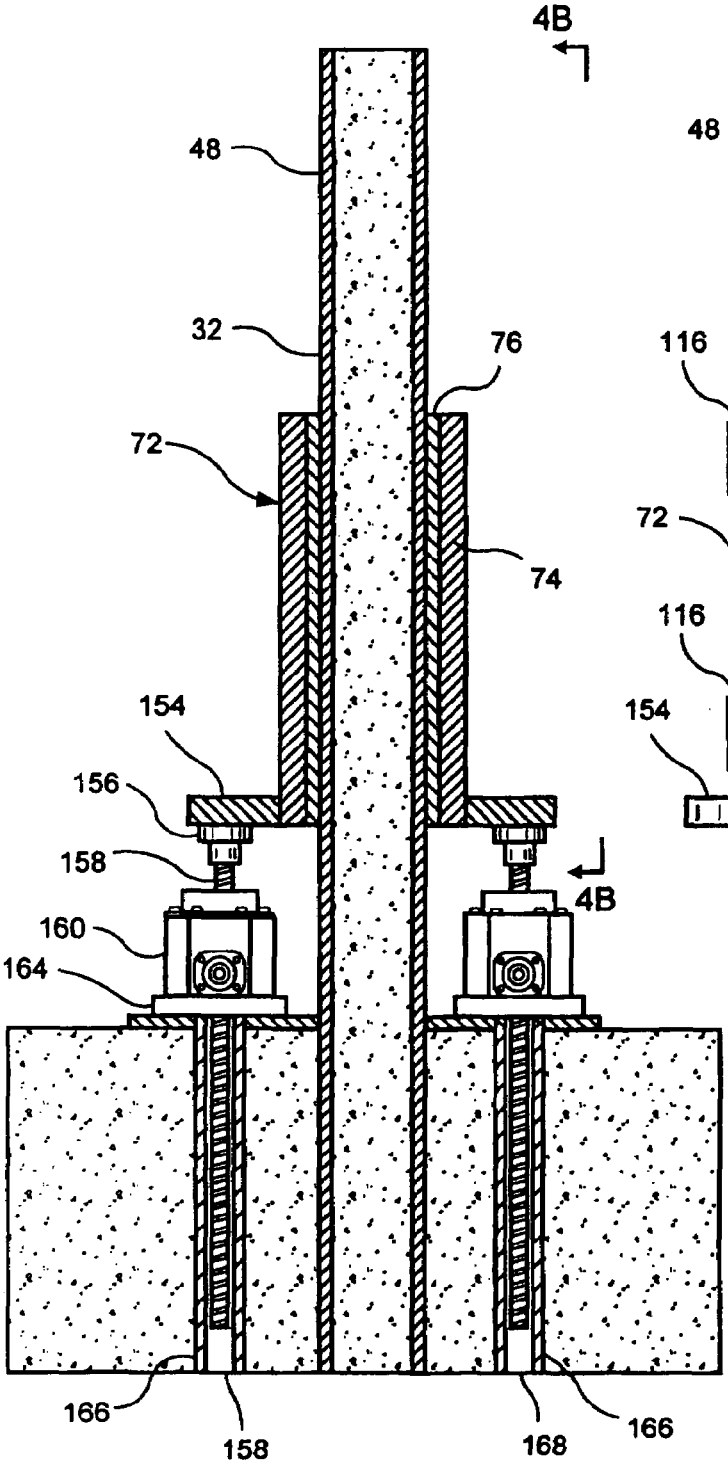
FIG. 4A is a sectional view of a stanchion with sleeve and net raising and lowering jacks.
Figure 4B:
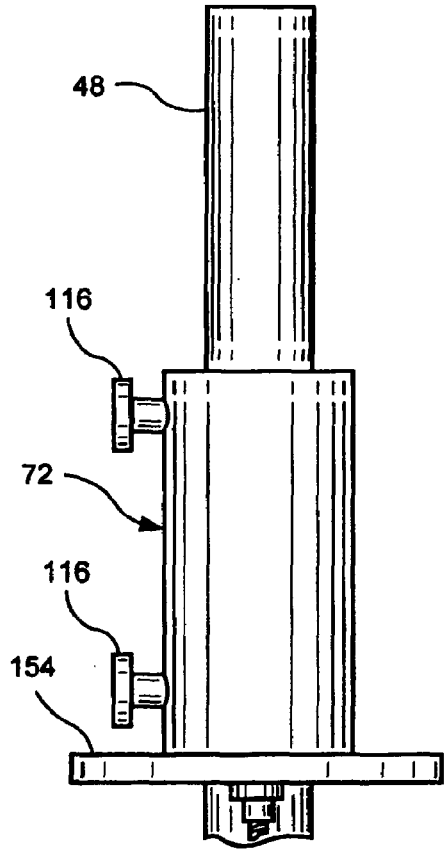
FIG. 4B is a side view of a stanchion with sleeve and net raising and lowering jacks.
Figure 8:
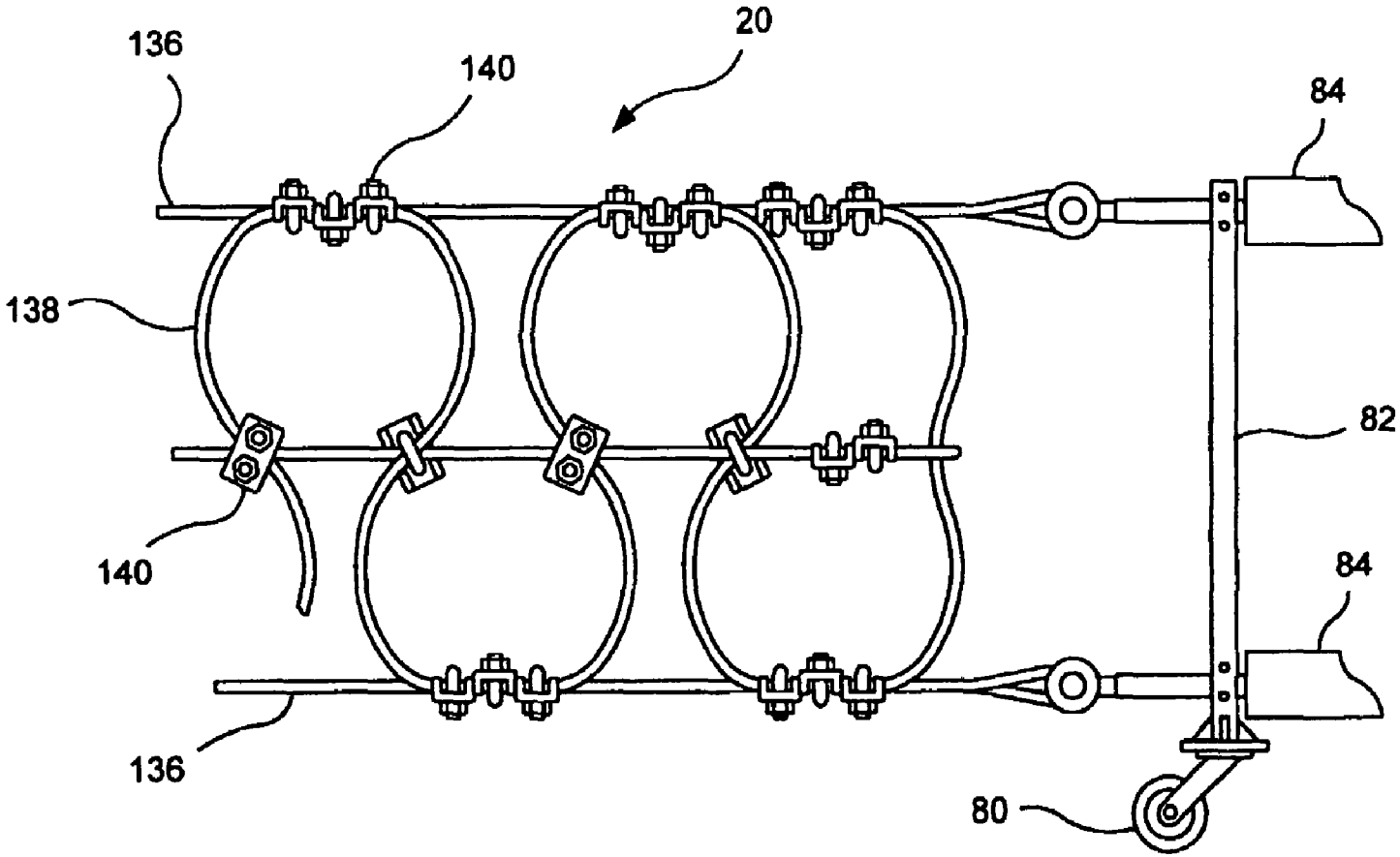
FIG. 8 is an expanded side view of a net according to one embodiment.

The housing 110 of each shock absorbing mechanism 84 is fixed to steel sleeve 74, and its piston 112 is connected to net 20. The connection shown in FIGS. 3 and 8 are but exemplary of the many ways of attaching net 20 to piston 112.

In one embodiment, shock absorber 84 is hydraulic with about a 50,000 pound resistance with a twelve inch stroke and an accumulator with a 5,000 pound return force. In a another embodiment, shock absorber 84 is hydraulic with about a 20,000 pound resistance with a four foot stroke and an accumulator with a 5,000 pound return force.

As best seen in FIG. 5, steel sleeve 74 has flanges 116 which connect to shock absorber flange 114. Shock absorber cylinder 110 is removably mounted thereto by flanges 114. Shock absorber piston 112 is removably attached to the net 20. In one embodiment, the attachment is effected by means of a threaded extension 118 of piston 112 which is received in an internally threaded sleeve-bolt (not shown) attached to the net 20. Preferably, the attachment is effected by means of an eyelet extension 119 of piston 112, as shown in FIGS. 6-7, through which a cable, clamp or other appropriate securing mechanism may be passed in order to secure the net 20 to the piston 112.

Figure 6A:
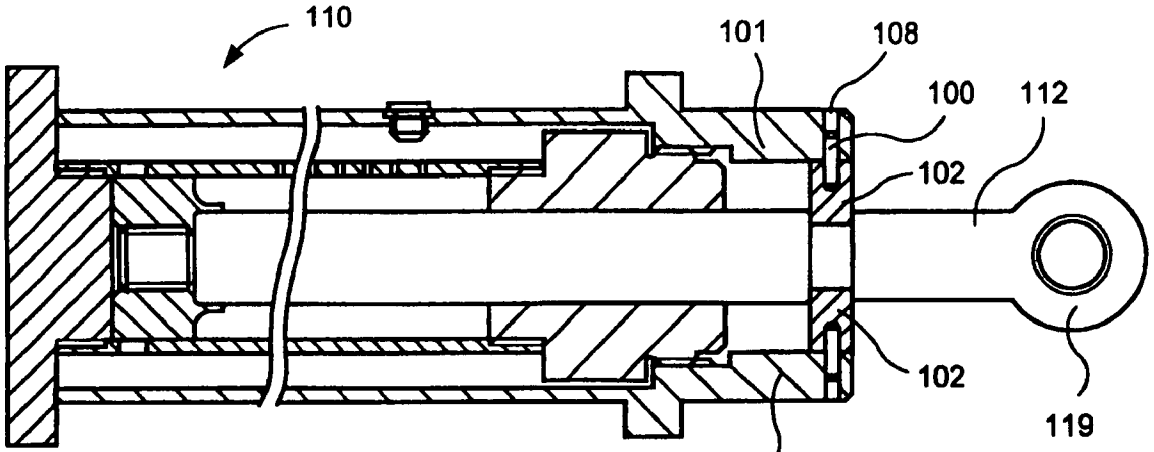
FIG. 6A is a side view of a preferred embodiment of a hydraulic shock absorber with shear pins to act as threshold force securing mechanism, shown partially cut away and in its quiescent state.
Figure 6B:
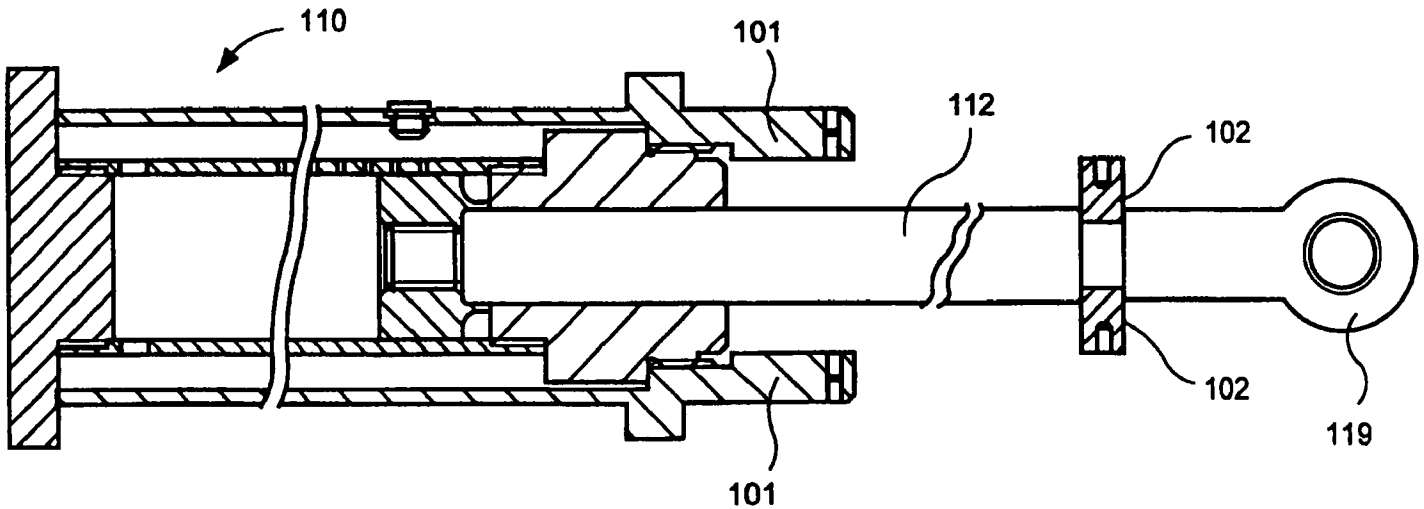
FIG. 6B is a side view of a preferred embodiment of a hydraulic shock absorber with shear pins to act as threshold force securing mechanism, shown partially cut away and in its expanded state after a vehicular collision with the net.

FIGS. 6A and 6B illustrate a preferred embodiment of the shock absorbing mechanism. Shock absorbers 84 are shown in their quiescent state and their expanded state, respectively. Being top views, only the top shock absorber 84 is seen, the other lying directly beneath the one visible. In the quiescent state (FIG. 6A), net 20 is stretched transversely across roadway 10 in the manner exemplified by bottom net 20 in FIG. 1. As shown in FIG. 6A, net 20 has not yet been subject to collision with a vehicle.

Shock absorber 84 is normally in a compressed state, secured by a threshold force securing mechanism. The mechanism is capable of withstanding a threshold tensile force. In one embodiment, a threshold force securing mechanism includes a series of shear pins 100 inserted through a shear pin collar 101 into a shear pin ring 102. The shear pin collar 101 may be integral or separate from other parts of the shock absorber. The shear pin optionally may be secured by a set screw 103. One can readily envision other threshold force securing mechanisms that may be used in combination with, or instead of, a shear pin. For example a securing mechanism such as a brake pad, or a counterweight, or other counterforce may be used. The threshold force securing mechanism allows the shock absorber 84, without expanding from its compressed state, to pull net 20 taut. The shock absorber on the other side of roadway 10, in an identical configuration, will pull the other side of the net 20 taut. Typically, capture net 20 is installed with a 5,000-10,000 pound pre-tension horizontal load on its cables.

When an automobile 26 collides with net 20, the automobile deflects the net, causing it to exert a tensile force exceeding the minimum threshold force upon shock absorber 84. When the threshold force means includes shear pins, the tensile force causes the pins to shear and thereby permits the expansion of piston 112 of shock absorber 84 against the resistance of the hydraulic fluid in cylinder 110 (FIG. 6B). Shock is thereby absorbed during its expansion, while the force of the net 20 also rotates shock absorber 84 and bearing sleeve 72. Forces applied upon net 20 are thereby translated through the center of stanchion 32, which is solidly anchored in foundation 34. Energy is distributed among and absorbed by the net 20, the shock absorbers 84 and the stanchion 32. This permits a relatively compact size while being effective in resisting applied forces.

Figure 7A:
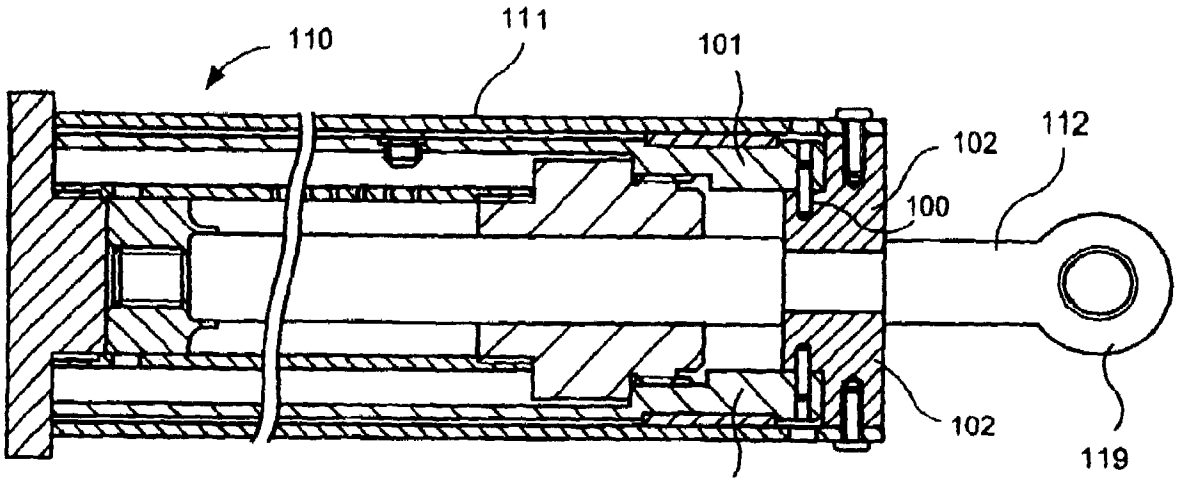
FIG. 7A is a side view of a second preferred embodiment of a hydraulic shock absorber with shear pins to act as threshold force securing mechanism and a torque protection structure, shown partially cut away and in its quiescent state.
Figure 7B:
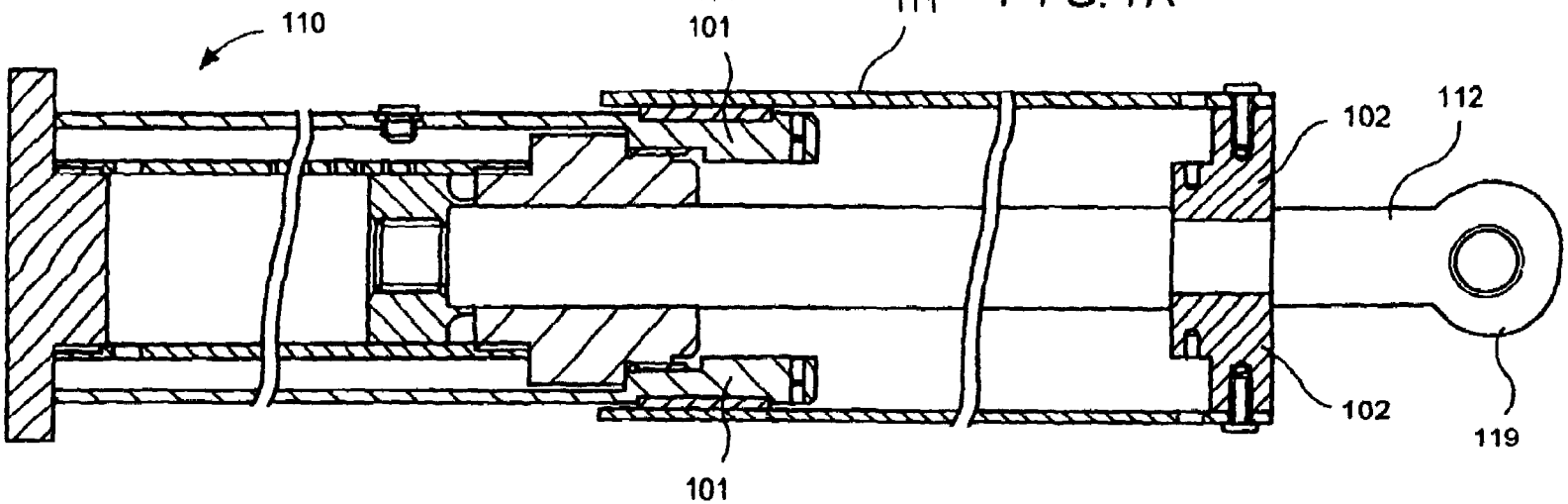
FIG. 7B is a side view of a second preferred embodiment of a hydraulic shock absorber with shear pins to act as threshold force securing mechanism and a torque protection structure, shown partially cut away and in its expanded state after a vehicular collision with the net.

A second embodiment of the shock absorbing mechanism includes a torque protection structure. In a preferred aspect as illustrated in FIGS. 7A and 7B, shock absorbers 84 include a protective sleeve 111 which adds structural strength to resist deformation of the housing 110 or other parts of the shock absorber 84 due to the torque that the net 20 exerts upon capturing an automobile and deflecting shock absorbers 84. The protective sleeve 111 may be made of any suitable structural material, but is preferably aluminum or steel.

Referring to FIGS. 1, 3, and 8, the restraining mechanism includes a net 20 comprising a plurality of horizontally extending structural cables 136 made of one inch galvanized structural strands with a breaking strength of sixty-one tons or more. In one embodiment of the restraining mechanism, the structural cables 136 are connected by a plurality of vertically extending cables 138, as shown in FIG. 1A. These vertical cables 138 are preferably five-eighths inch galvanized structural strands with a minimum breaking strength of twenty-four tons, connected to horizontal strands 136 through swaged sockets.

Figure 1B:
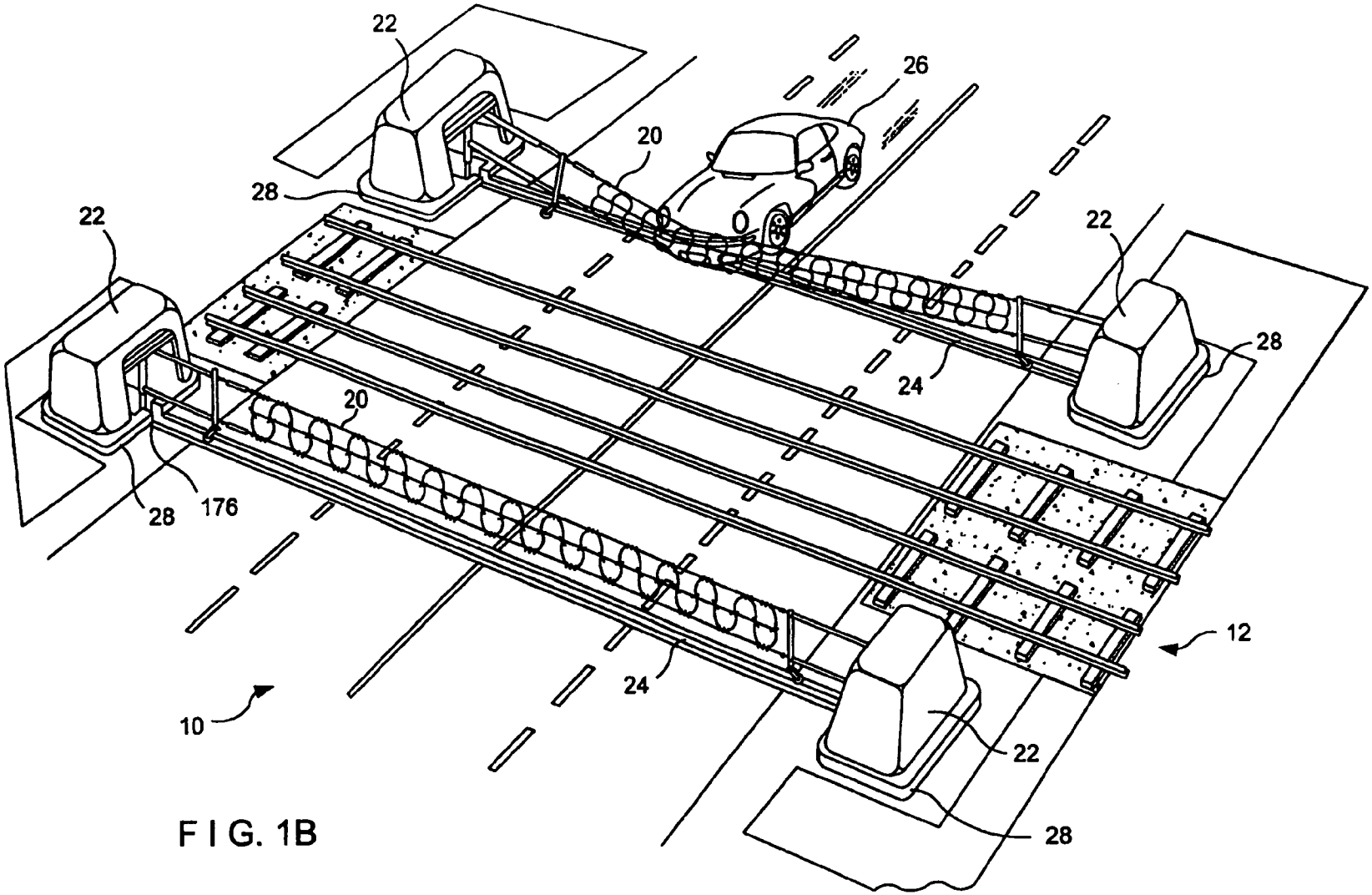
FIG. 1B is a perspective view which illustrates a railroad crossing for a multi-lane roadway with a preferred embodiment installed and restraining an automobile.

In another embodiment of the restraining mechanism, the structural cables 136 are connected by horseshoe cable 138, as shown in FIGS. 1B, 3 and 8. Preferably, the horseshoe cable comprises wire rope and may be secured to the structural cables by wire rope cable clamps 140. The horseshoe cable may comprise a plurality of cables, but it is preferred that it be more unitary. The horseshoe cable design provides exemplary automobile capturing properties by allowing the net to wrap around the automobile, preventing it from slipping over the net. As seen in FIGS. 1B, 3 and 8, the cable extends substantially horizontally in a wave pattern with vertical amplitude, having peaks, valleys and midpoints. In the embodiment shown in these figures, the peaks are located at the top horizontal cable, the valleys are located at the bottom horizontal cable, and the midpoints are located at the middle horizontal cable. It is evident from the figures that the tangents of the wave midpoints are more than 90 degrees from tangents of the peaks and valleys.

Returning to FIGS. 4A and 4B, a preferred form of the lift mechanism will now be described. Steel sleeve 74 of bearing sleeve 72 has integrally fixed thereto a lift flange 154, shown as circular in FIGS. 4 and 5, but which could be of any suitable configuration. It is convenient and practical to make bearing sleeve 72 complete at the factory. Bronze insert 76 is press-fit into steel sleeve 74 and reamed to size, and flanges 116 and 154 are welded to sleeve 74. The unit is then ready to be brought to the site and simply installed on steel pipe 48 which was previously milled to mate with insert 76.

Lift flange 154 rests on caps 156 of lifting screws 158 of lifting jacks 160. Lifting jacks 160 should preferably be capable of supporting a minimum of 5,000 pounds at a screw extension of forty-eight inches and are supplied with motors 162 (FIG. 2) and speed reducers (not shown) which are preferably capable of lifting 3500 pounds per jack forty-eight inches in twenty seconds. The operation of lifting jacks 160 can conveniently be synchronized through the use of rotary limit switches. Lifting jacks 160 are mounted on base plate 164. Base plate 164 can desirably be welded to steel pipe 48. Integrally depending from base plate 164, and thereby controllably spaced appropriately, are a pair of three inch steel pipes 166 which provide pockets 168 for lifting screws 158. Integrally constructing pipe 48, base plate 164, and pipes 166 prior to removal to the site also simplifies on-site construction, for they can be brought to the site as a unit and simply dropped into place. Even more preferably, the unit may be pre-installed (off-site) in bunker 30 which itself may be brought to the site and installed.

Housing 22 is shown in FIG. 1 is preferably a prefabricated enclosure with stainless steel outer panels so that it can withstand even the most rigorous of weather conditions. The side panels of housing 22 may be hinged for easy access, or housing 22 may be a unitary enclosure which is removable from bunker walls 36. Within housing 22, a stainless steel roll up door (not shown) may be included, which is raised by net 20 and which closes automatically due to gravity.

In operation, a control system (not disclosed) will sense the presence of an oncoming train and will thereby control net operations. Lift motors 162 will be synchronously actuated so that lift screws 158 of lift jacks 160 will raise bearing sleeve 72 and therewith net 20. Should a vehicle crash into net 20, net 20 will deflect, rotating shock absorbing mechanisms 78 about axis 52 of stanchion 32 and expanding hydraulic shock absorbers 84 to restrain the vehicle. The restraining forces will act through axis 52, placing the strain upon a concrete filled steel pipe embedded solidly in a concrete foundation. After the train passes, the control system will reverse motors 162 to lower net 20 into slot 24 of concrete structure or net slot 58.

In addition to railroad crossings, the system can also be used in a variety of other applications, including HOV lane traffic control, drawbridges, security gates, or crash cushion applications. One can readily appreciate that the control system for such applications may differ from that used in a railroad crossings. At security gates, for example, the restraining net or other barrier would normally be in a raised position, and actuation of the security system (e.g., by a guard, a key card, keyboard punch, etc.) would lower the barrier and permit passage.

EXAMPLE

An embodiment similar to that shown in FIGS. 3A and 3B was constructed without ground retractability, as follows. The overall width of the installation was 18.4 m (60.4 ft) centerline to centerline of the stanchions. The net width was 10.5 m (34.5 ft). The uninstalled constructed net height was 0.9 m (3.0 ft). The height of the net when installed and tensioned was 1.0 m (3.3 ft) to the center of the top cable and 0.2 m (0.7 ft) to the center of the bottom cable as measured at the centerline of the net assembly. A measure of the tension was recorded in the top and bottom cables of 27.5 kN (6182.3 lb) and 17.5 kN (3934.2 lb), respectively.

The cable net was constructed of three equally spaced horizontal members. The top and bottom horizontals were 19 mm (0.8 in) diameter Extra High Strength (EHS) wire strand. The center horizontal was 16 mm diameter 6×26 wire rope. The horseshoe cable net members were fabricated of a single 16 mm (0.6 in) diameter 6×26 wire rope. The wire rope was woven up and down along the net width and attached to the top and bottom horizontal wire strand members with three 19 mm (0.8 in) cable clamps at each location and a single 32 mm (1.3 in) modified cable clamp where the rope passed over the center strand. The ends of the top and bottom strands were fitted with Preformed Line ProductS™ 1.8 m (6.0 ft) Big Grip Dead Ends. The net was attached on one side to shock absorbers with a 32 mm (1.3 in)×457 mm (18 in) turnbuckle and 19 mm (0.8 in) clevis at the top and bottom horizontal strand locations. The opposing net end was connected to shock absorbers with a 19 mm (0.8 in) clevis at the top and bottom horizontal strand locations.

The stanchions were fabricated from two sections of steel pipe to form a rotating or hinged anchor system. The anchored inner section of the stanchion was fabricated from A36 steel pipe 305 mm (12.0 in) O.D., 25 mm (1.0 in) wall×1372 mm (54.0 in). Additionally, two 6 mm (0.25 in) rolled bronze plates were welded to each inner section to form bearings. A 6 mm (0.3 in) thick×54 mm (2.1 in) wide steel shelf ring was welded to the perimeter of the inner section to vertically support the outer section 152 mm (6.0 in) above the roadway surface. The inner section was fillet welded to a 25 mm (1.0 in)×686 mm (27.0 in)×686 mm (27.0 in) steel plate and anchored with sixteen 25 mm (1.0 in) mechanical anchors. The outer section was fabricated from A36 steel pipe 381 mm (15.0 in) O.D., 19 mm (0.8 in) wall×1372 mm (54.0 in).

The hydraulic shock absorber cylinders were 2.9 m (9.6 ft) long overall. The effective piston stroke was 2.4 m (8.0 ft).

Although this particular embodiment was not ground retractable, it is understood that a variety of means could be employed to permit partial or complete ground retraction of the net and/or stanchions in this and other embodiments. For example, the vertically slidable bearing sleeve discussed above would be one option for allowing retraction of the net. Another option might be to retract the all or part of the stanchion, for example vertically or by pivoting it about a horizontal axis.

We claim:

1. An energy absorbing system comprising:

a stanchion;

a linearly extendable energy absorber having a proximal end coupled to the stanchion;

a net coupled to a distal end of the energy absorber, wherein the net transfers force to the energy absorber;

a securing mechanism in mechanical communication with the energy absorber, where the securing mechanism allows linear expansion of the energy absorber when acted upon by tensile forces of at least a minimum threshold force; and means for retracting at least a portion of the system into the ground.

2. The energy absorbing system according to claim 1, wherein the securing mechanism is one of a pin, a brake, and a counterweight.

3. The energy absorbing system according to claim 1, wherein at least a portion of the net is retractable into the ground.

4. An energy absorbing system comprising:

a stanchion;

a linearly extendable energy absorber having a proximal end coupled to the stanchion;

a net coupled to a distal end of the energy absorber, wherein the net transfers force to the energy absorber;

a securing mechanism in mechanical communication with the energy absorber where the securing mechanism allows linear compression of the energy absorber when acted upon by tensile forces of at least a minimum threshold force; and means for retracting at least a portion of the system into the ground.

5. The energy absorbing system according to claim 4, wherein at least a portion of the net is retractable into the ground.

6. An energy absorbing system comprising:

a stanchion;

a linearly extendable energy absorber having a proximal end coupled to the stanchion;

a net coupled to a distal end of the energy absorber, wherein the net transfers force to the energy absorber;

a securing mechanism that maintains tension between the net and the energy absorber until acted upon by tensile forces of at least a minimum threshold force, wherein at least a portion of the system is retractable into the ground.

7. The energy absorbing system according to claim 6, wherein at least a portion of the net is retractable into the ground.

8. The energy absorbing system according to claim 6, wherein the securing mechanism is one of a pin, a brake, and a counterweight.

9. An energy absorbing system comprising:

a stanchion;

a linearly extendable energy absorber having a proximal end coupled to the stanchion;

a net coupled to a distal end of the energy absorber, wherein the net transfers force to the energy absorber;

a securing mechanism that allows one of expansion and compression of the energy absorber when acted upon by tensile forces of at least a minimum threshold force.

10. The energy absorbing system according to claim 9, wherein at least a portion of the net is retractable into the ground.

* * * * *